US012778185B2

(12) United States Patent
Joyeux

(10) Patent No.: US 12,778,185 B2
(45) Date of Patent: Nov. 3, 2026

(54) STABLE WRAPPER FOR AEROSOL GENERATING ARTICLE

(71) Applicant: PHILIP MORRIS PRODUCTS S.A., Neuchâtel (CH)

(72) Inventor: Thierry Joyeux, Morges (CH)

(73) Assignee: Philip Morris Products S.A., Neuchâtel (CH)

( * ) Notice: Subject to any disclaimer, the term of this patent is extended or adjusted under 35 U.S.C. 154(b) by 1196 days.

(21) Appl. No.: 17/612,756

(22) PCT Filed: Jun. 8, 2020

(86) PCT No.: PCT/IB2020/055369

§ 371 (c)(1),
(2) Date: Nov. 19, 2021

(87) PCT Pub. No.: WO2020/250109

PCT Pub. Date: Dec. 17, 2020

(65) Prior Publication Data

US 2022/0295871 A1 Sep. 22, 2022

(30) Foreign Application Priority Data

Jun. 10, 2019 (EP) ..... 19179245

(51) Int. Cl.
*A24D 1/02* (2006.01)
*A24B 15/14* (2006.01)
(Continued)

(52) U.S. Cl.
CPC ..... *A24D 1/02* (2013.01); *A24B 15/14* (2013.01); *A24B 15/167* (2016.11); *A24D 1/20* (2020.01); *A24F 40/465* (2020.01)

(58) Field of Classification Search
None
See application file for complete search history.

(56) References Cited

U.S. PATENT DOCUMENTS 4,341,228 A 7/1982 Keritsis
5,143,099 A 9/1992 Le Gars
(Continued)

FOREIGN PATENT DOCUMENTS

CH 691156 5/2001
CN 106255429 A 12/2016
(Continued)

OTHER PUBLICATIONS

WO 2016166012 A1 English Translation obtained from Espacenet, pp. 1-17 (Year: 2016).*
(Continued)

*Primary Examiner* — Philip Y Louie
*Assistant Examiner* — Madeleine P Delacruz
(74) *Attorney, Agent, or Firm* — Mueting Raasch Group

(57) ABSTRACT

A wrapper (50) used in aerosol generating articles (10). The paper wrapper has a low elongation to break ratio and is utilized with an aerosol generating substrate (20). The aerosol generating article includes the aerosol generating substrate comprising nicotine and at least 10% aerosol former comprising glycerine. The wrapper is disposed about and in contact with the aerosol generating substrate. The wrapper comprises a paper layer having an elongation at break ratio cross direction/machine direction (CD/MD) of 2.5 or less.

18 Claims, 3 Drawing Sheets

(51) Int. Cl.

| | |
|---|---|
| ***A24B 15/167*** | (2020.01) |
| ***A24D 1/20*** | (2020.01) |
| ***A24F 40/465*** | (2020.01) |

(56) References Cited

U.S. PATENT DOCUMENTS

| | | | | |
|---|---|---|---|---|
| 5,584,306 | A | 12/1996 | Beauman | |
| 5,724,998 | A | 3/1998 | Gellatly | |
| 6,161,552 | A | 12/2000 | Case | |
| 6,216,706 | B1 | 4/2001 | Kumar | |
| 10,760,219 | B2 | 9/2020 | Niemi | |
| 10,993,473 | B2 | 5/2021 | Malgat | |
| 11,083,217 | B2 | 8/2021 | Bachmann | |
| 2002/0157678 | A1* | 10/2002 | Hampl, Jr. | A24D 1/02 131/365 |
| 2003/0131860 | A1 | 7/2003 | Ashcraft | |
| 2014/0113080 | A1 | 4/2014 | Stinga | |
| 2014/0300548 | A1 | 10/2014 | Zuber | |
| 2014/0305448 | A1 | 10/2014 | Zuber et al. | |
| 2015/0272203 | A1 | 10/2015 | Holford | |
| 2016/0157519 | A1 | 6/2016 | Guyard | |
| 2016/0309781 | A1 | 10/2016 | Malgat et al. | |
| 2017/0119048 | A1 | 5/2017 | Kaufman | |
| 2017/0215475 | A1 | 8/2017 | Besso | |
| 2017/0280766 | A1 | 10/2017 | Besso | |
| 2017/0360082 | A1 | 12/2017 | Slama | |
| 2018/0125113 | A1 | 5/2018 | Minzoni | |
| 2018/0279666 | A1 | 10/2018 | Aoun | |
| 2018/0310608 | A1* | 11/2018 | Sciboz | A24B 15/14 |
| 2019/0059443 | A1 | 2/2019 | Bachmann | |
| 2019/0075851 | A1 | 3/2019 | Mironov | |
| 2019/0203423 | A1 | 7/2019 | Niemi | |
| 2019/0269169 | A1 | 9/2019 | Malgat | |
| 2021/0177041 | A1* | 6/2021 | Aoun | A24B 15/167 |
| 2021/0244084 | A1* | 8/2021 | Sakurai | A24D 1/20 |

FOREIGN PATENT DOCUMENTS

| | | | | | |
|---|---|---|---|---|---|
| CN | 106480778 | A | * | 3/2017 | D21H 19/40 |
| CN | 107429490 | A | | 12/2017 | |
| CN | 109043654 | A | | 12/2018 | |
| CN | 109183494 | | | 1/2019 | |
| CN | 109496128 | A | | 3/2019 | |
| CN | 109680540 | | | 4/2019 | |
| DE | 102016106852 | | | 10/2017 | |
| EP | 407022 | | | 1/1991 | |
| EP | 822670 | | | 2/1998 | |
| EP | 981971 | | | 3/2000 | |
| EP | 2644043 | | | 10/2013 | |
| EP | 2740370 | | | 6/2014 | |
| EP | 3086669 | | | 11/2016 | |
| EP | 3199702 | | | 8/2017 | |
| EP | 3449739 | | | 3/2019 | |
| EP | 3453268 | | | 3/2019 | |
| EP | 3352594 | | | 11/2019 | |
| GB | 2143150 | A | * | 2/1985 | A24D 1/02 |
| JP | 2018515119 | | | 6/2018 | |
| KR | 101726501 | | | 4/2017 | |
| WO | WO-2010118122 | A1 | * | 10/2010 | A24D 3/14 |
| WO | 2014087529 | | | 6/2014 | |
| WO | WO 2015/176898 | A1 | | 11/2015 | |
| WO | 20160050470 | | | 4/2016 | |
| WO | WO-2016166012 | A1 | * | 10/2016 | A24C 5/005 |
| WO | 20170051011 | | | 3/2017 | |
| WO | 20170137857 | | | 8/2017 | |
| WO | 20170178604 | | | 10/2017 | |
| WO | 20180122320 | | | 7/2018 | |
| WO | 20200100879 | | | 5/2022 | |

OTHER PUBLICATIONS

English Translation of CN106480778A obtained from Espacenet, pp. 1-54 (Year: 2017).*

European Search Report for EP19179245.6 issued by the European Patent Office, Dec. 20, 2019; 9 pgs.

International Search Report and Written Opinion for PCT/IB2020/055369 issued by the European Patent Office, Sep. 4, 2020; 16 pgs.

International Preliminary Report on Patentability for PCT/IB2020/055369 issued by the European Patent Office, Aug. 31, 2021; 12 pgs.

Doring et al., "Thermally Sprayed coats for the paper and paper-converting industries," Welding and Cutting, 2012;11 (2): 2 pgs.

Chinese Office Action for CN Application No. 202080036428.5 issued by the China National Intellectual Property Administration on Feb. 21, 2023; 16 pgs. Including English translation.

* cited by examiner

STABLE WRAPPER FOR AEROSOL GENERATING ARTICLE

This application is the § 371 U.S. National Stage of International Application No. PCT/IB2020/055369, filed 8 Jun. 2020, which claims the benefit of European Application No. 19179245.6, filed 10 Jun. 2019, the disclosures of which are incorporated herein by reference.

The present disclosure relates to a wrapper used in aerosol generating articles, wherein the paper wrapper has a low elongation to break ratio and may be utilized with an aerosol generating substrate.

Aerosol generating articles in which an aerosol generating substrate, such as a tobacco containing substrate, is heated rather than combusted, are known in the art. Typically in such heated aerosol generating articles, an aerosol is generated by the transfer of heat from a heat source to a physically separate aerosol generating substrate or material, which may be located in contact with, within, around, or downstream of the heat source. During use of the aerosol generating article, volatile compounds are released from the aerosol generating substrate by heat transfer from the heat source and are entrained in air drawn through the aerosol generating article. As the released compounds cool, they condense to form an aerosol.

Paper that is used to wrap the aerosol generating substrate can absorb aerosol former, water and other liquid compounds found in the mainstream smoke or aerosol passing through the aerosol generating article, or humidity or moisture surrounding the paper. The absorbed liquid may stain or weaken the paper and negatively affects the appearance and structural integrity of the aerosol generating article. Heated aerosol generating articles are particularly susceptible to wetting and breakage due to the high levels of aerosol former in the aerosol generating substrate of these heated aerosol generating articles. Heated aerosol generating articles are particularly susceptible to swelling as aerosol components are absorbed by the wrapper, leading to difficult removal from the heating device. Heated aerosol generating articles are particularly susceptible to breakage when they are tightly received and then removed from a heating device.

It would be desirable to provide a visually and mechanically stable wrapped aerosol generating substrate, particularly for aerosol generating articles that contain a high level of liquids or aerosol formers.

It would be desirable to provide an aerosol generating article that included a wrapper that did not swell up by absorbing water or compounds contained in the aerosol generating substrate.

It would be desirable to provide an aerosol generating article that included a wrapper that provided a grease barrier to grease compounds contained in the aerosol generating substrate.

It would also be desirable that this wrapper not affect the taste of the aerosol generated by the aerosol generating article.

It would also be desirable that this wrapper not readily burn if proximate a heating element.

The purpose of the invention may be to solve at least partially one or more of the desirable technical benefits mentioned above.

According to this disclosure, there is provided an aerosol generating article comprising an aerosol generating substrate comprising nicotine, and a wrapper disposed about the aerosol generating substrate. The wrapper comprises a paper layer having an elongation at break ratio of CD/MD is 2.5 or less.

According to this disclosure, there is provided an aerosol generating article comprising an aerosol generating substrate comprising nicotine and at least about 10% aerosol former comprising glycerine, and a wrapper disposed about and in contact with the aerosol generating substrate. The wrapper comprises a paper layer having an elongation at break ratio of cross direction/machine direction (CD/MD) is about 2.5 or less.

The term "MD" refers to a machine-direction of the wrapper. The machine-direction is the direction paper stock flows into and through a papermaking machine. The machine-direction is the circumferential direction of a roll of paper being wound up from the paper machine. The machine-direction may also be referred to as the grain direction.

The term "CD" refers to a cross-direction of the wrapper. The cross-direction of the wrapper is an in-plane direction of the wrapper. The cross-direction of the wrapper is orthogonal to the machine-direction of the wrapper.

According to this disclosure, there is provided an aerosol generating article. The aerosol generating article may comprise an aerosol generating substrate. The aerosol generating substrate may include a wrapper. The wrapper may be disposed about the aerosol generating substrate. The wrapper comprises a paper layer having an elongation at break ratio of CD/MD of about 2.5 or less.

Preferably the paper layer has an elongation at break ratio of CD/MD is about 2.2 or less. Preferably the paper layer has an elongation at break ratio of CD/MD is about 2 or less. Preferably the paper layer has an elongation at break ratio of CD/MD is in a range from about 1.8 to about 2.2.

Preferably the paper layer has a thickness/grammage in a range from about 1.0 micrometers/gsm to about 1.2 micrometers/gsm. The paper layer may have a thickness of less than about 50 micrometers, or less than about 40 micrometers. The wrapper includes a paper layer having a grammage in a range from about 25 gsm to about 45 gsm, or from about 35 gsm to about 40 gsm. Preferably, the paper layer has a grammage in a range from about 25 gsm to about 45 gsm, and a thickness in a range from about 35 micrometers to about 50 micrometers.

Preferably, the paper layer has an elongation at break ratio of CD/MD of about 2.5 or less and a water contact angle of at least about 30 degrees. The paper layer may have a water contact angle of at least about 40 degrees, or at least about 45 degrees.

Preferably, the wrapper comprises a paper layer having an elongation at break ratio of CD/MD of about 2.5 or less and a negative result for at least one kit oil sample of method Tappi 559 cm-02 classical method 2002. The paper layer may have a negative result for at least five kit oil samples, or all ten kit oil samples of method Tappi 559 cm-02 classical method 2002.

Preferably, the wrapper includes two paper layers wherein a first paper layer has a first elongation at break ratio of CD/MD of about 2.5 or less value and the second paper layer has a second elongation at break ratio of CD/MD of about 2.5 or less. The wrapper may have a total thickness of less than about 80 micrometers.

Preferably, the wrapper comprises PVOH (polyvinyl alcohol) or silicon. The paper layer may comprise a surface treatment comprising PVOH or silicon. Addition of PVOH (polyvinyl alcohol) or silicon may improve the grease barrier properties of the wrapper.

The term "silicon" refers to siloxane. Silicon or siloxane preferably comprises a polydimethylsiloxane.

Preferably, the aerosol generating substrate may comprise homogenized tobacco material. The tobacco homogenized tobacco material may comprise tobacco material, from about 1% to about 5% of a binder, and from about 5% to about 30% of an aerosol-former, in dry weight basis.

Preferably, the aerosol generating substrate may comprise a gel composition. The gel composition may comprise a majority (by weight) of glycerine. The gel composition may comprise xanthan gum.

Preferably, the aerosol generating substrate may comprise a metallic induction heating element. The metallic induction heating element may comprise plurality of metallic induction heating elements. The metallic induction heating element may comprise a metallic induction heating ring element.

The wrapper may be formed of a single paper layer. The wrapper may be formed of two layers of paper. The wrapper may be formed of more than two layers of paper.

Preferably the wrapper covers at least 20%, at least 50%, at least 80%, at least 90%, at least 95%, at least 99% or preferentially about the full length (the entire length) of the aerosol generating substrate. The wrapper preferably covers the entire aerosol generating substrate and does not extend beyond the aerosol generating substrate.

When the wrapper has two or more paper layers, a first paper layer may possess the unique properties described herein and a second paper layer may be considered a conventional paper layer. The second paper layer may preferably be disposed over the first paper layer. Alternatively, the first paper layer may be disposed over the second paper layer. Preferably the first paper layer, having the unique properties described herein, is in contact with the aerosol forming substrate.

When the wrapper has two or more paper layers, a first paper layer may possess the unique properties described herein and a second paper layer may also possess the unique properties described herein. All the paper layers forming the wrapper may possess the unique properties described herein. In particular, one or both paper layers forming the wrapper may comprises PVOH (polyvinyl alcohol) or silicon. One or both paper layers forming the wrapper may comprise a surface treatment comprising PVOH or silicon.

Advantageously, aerosol generating articles that include a wrapper described herein may reduce wetting, absorption of water, aerosol formers, or grease in the smoke or aerosol passing through the aerosol generating article. As a result, swelling, visible staining and physical weakening of the wrapper portion of the aerosol generating article may be reduced even when a high level of aerosol former is included in the aerosol generating substrate.

Advantageously, the aerosol generating article provides a visually and mechanically stable wrapped aerosol generating substrate that avoids swelling. This is particularly useful for heat-not-burn aerosol generating articles that may be inserted into heating device. The aerosol generating article wrapper resists burning if proximate a heating element, thus inductive heating elements may be incorporated throughout the aerosol generating substrate.

Paper wrappers having an elongation at break ratio of CD/MD value being 2.5 or less exhibit reduced paper swelling. Preferably paper wrappers having an elongation at break ratio of CD/MD value being in a range from about 1.8 to about 2.2 or about 2 or less exhibit reduced paper swelling.

The term "aerosol generating article" is used herein to denote an article wherein an aerosol generating substrate is heated to produce and deliver inhalable aerosol to a consumer. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming substrate. For example, aerosol generating articles according to the disclosure find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822670.

As used herein, the term "aerosol generating device" refers to a device comprising a heater element that interacts with the aerosol generating substrate of the aerosol generating article to generate an aerosol.

As used herein, the term "aerosol generating system" refers to a combination of an aerosol generating device and an aerosol generating article.

The term "aerosol generating substrate" refers to substance capable of generating or releasing an aerosol. The aerosol generating substrate may be a solid, paste, gel, slurry, liquid, or comprise any combination of solid, paste, gel, slurry, and liquid compounds. Preferably the aerosol generating substrate is a solid, or a gel composition. The aerosol generating substrate may preferably include nicotine.

The aerosol generating article may comprise an aerosol generating substrate and a mouthpiece. The mouthpiece may comprise a filter. A tipping wrapper may join the filter to the aerosol generating substrate.

An aerosol generating substrate may be a solid composition. This composition may include plant-based material. The aerosol generating substrate may include tobacco, and preferably the tobacco contains volatile tobacco flavour compounds, which are released from the aerosol generating substrate upon heating. The aerosol generating substrate may comprise homogenized tobacco material, aerosol former and a binder.

Nicotine may be present in the aerosol generating substrate in a range from about 0.5 to about 10% wt, nicotine, or about 0.5 to about 5% wt. nicotine. Preferably the aerosol generating substrate may include about 1 to about 3% wt, nicotine, or about 1.5 to about 2.5% wt. nicotine, or about 2% wt nicotine.

The aerosol generating substrate may include a flavourant. Botanical materials provide flavourant that may impart a flavour to the taste of the aerosol generated by the aerosol generating article. A flavourant is any natural or artificial compound that affects the organoleptic quality of the aerosol. Non-limiting examples of sources of flavourants include mints such as peppermint and spearmint, coffee, tea, cinnamon, clove, cocoa, vanilla, eucalyptus, geranium, agave, and juniper; and combinations thereof.

The aerosol generating substrate may include an essential oil. Essential oils may provide flavourant that may impart a flavour to the taste of the aerosol generated by the aerosol generating article. Suitable essential oils include, but are not limited to, eugenol, peppermint oil and spearmint oil. A preferred essential oil is eugenol. Essential oil may be present in the aerosol generating substrate in an amount of at least about 0.1% by weight, or at least about 0.5% by weight, or at least about 1% by weight. Essential oil may be present in the aerosol generating substrate in a range from about 0.1% by weight to about 10% by weight, or from about 0.1% by weight to about 5% by weight, or from about 0.5% by weight to about 2%.

An aerosol generating substrate may include a gel composition. The term "gel" refers to a solid at room temperature. "Solid" in this context means that the gel has a stable size and shape and does not flow. Room temperature in this context means 25 degrees Celsius. A gel may be defined as a substantially dilute cross-linked system, which exhibits no flow when in the steady-state. By weight, gels may be mostly liquid, yet they behave like solids due to a three-dimensional cross-linked network within the liquid. It is the crosslinking within the fluid that gives a gel its structure (hardness). In this way gels may be a dispersion of molecules of a liquid within a solid in which liquid particles are dispersed in the solid medium.

The gel composition may include a gelling agent forming a solid medium, an aerosol former such as glycerine dispersed in the solid medium, and nicotine dispersed in the glycerine. The composition forming a stable gel phase. The gel composition may include at least two gelling agents forming a solid medium, glycerine dispersed in the solid medium, and nicotine dispersed in the glycerine. The composition forming a stable gel phase. The gel composition may include a viscosifying agent, and gelling agent forming a solid medium, glycerine dispersed in the solid medium, and nicotine dispersed in the glycerine. The composition forming a stable gel phase. A gel composition may include nicotine, an aerosol former, a viscosifying agent, a hydrogen-bond crosslinking gelling agent, and an ionic crosslinking gelling agent. The gel composition may further include divalent cations.

The term "viscosifying agent" refers to a compound that, when added homogeneously into a 25° C., 50% wt water/50% wt glycerine mixture, in an amount of 0.3% wt., increases the viscosity without leading to the formation of a gel, the mixture staying or remaining fluid. Preferably, the viscosifying agent refers to a compound that when added homogeneously into a 25° C. 50% wt water/50% wt glycerine mixture, in an amount of 0.3% wt, increases the viscosity to at least 50 cPs, preferably at least 200 cPs, preferably at least 500 cPs, preferably at least 1000 cPs at a shear rate of 0.1 $s^{-1}$, without leading to the formation of a gel, the mixture staying or remaining fluid. Preferably, the viscosifying agent refers to a compound that when added homogeneously into a 25° C. 50% wt water/50% wt glycerine mixture, in an amount of 0.3% wt, increases the viscosity at least 2 times, or at least 5 times, or at least 10 times, or at least 100 times higher than before addition, at a shear rate of 0.1 $s^{-1}$, without leading to the formation of a gel, the mixture staying or remaining fluid.

The viscosity values recited herein can be measured using Brookfield RVT viscometer rotating a disc type RV#2 spindle at 25° C. at a speed of 6 revolutions per minute (rpm).

The term "gelling agent" refers to a compound that homogeneously, when added to a 50% wt. water/50% wt. glycerine mixture, in an amount of about 0.3% wt, forms a solid medium or support matrix leading to a gel. Gelling agents include, but not limited to, hydrogen-bond crosslinking gelling agents, and ionic crosslinking gelling agents.

The term "hydrogen-bond crosslinking gelling agent" refers to a gelling agent that forms non-covalent crosslinking bonds or physical crosslinking bonds via hydrogen bonding. Hydrogen bonding is a type of electrostatic dipole-dipole attraction between molecules, not a covalent bond to a hydrogen atom. It results from the attractive force between a hydrogen atom covalently bonded to a very electronegative atom such as a N, O, or F atom and another very electronegative atom.

The term "ionic crosslinking gelling agent" refers to a gelling agent that forms non-covalent crosslinking bonds or physical crosslinking bonds via ionic bonding. Ionic crosslinking involves the association of polymer chains by non-covalent interactions. A crosslinked network is formed when multivalent molecules of opposite charges electrostatically attract each other giving rise to a crosslinked polymeric network.

The gel composition includes an aerosol former. Ideally the aerosol former is substantially resistant to thermal degradation at the operating temperature of the associated aerosol generating device. Suitable aerosol formers include, but are not limited to: polyhydric alcohols, such as triethylene glycol, 1,3-butanediol and glycerine; esters of polyhydric alcohols, such as glycerine mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1,3-butanediol and, glycerine (glycerine or propane-1,2,3-triol) or polyethylene glycol. The aerosol former is preferably glycerine.

The gel composition may include a majority of aerosol former such as glycerine. The gel composition may include a mixture of water and the glycerine where the glycerine forms a majority (by weight) of the gel composition. The glycerine may form at least about 50% wt. of the gel composition. The glycerine may form at least about 60% wt., or about 65% wt., or about 70% wt. of the gel composition. The glycerine may form at about 70% wt. to about 80% wt. of the gel composition. The glycerine may form at about 70% wt. to about 75% wt. of the gel composition.

The gel composition preferably comprises no water or a low level of water. When the gel composition comprises no water or a low level of water, the gel composition may comprise a higher level of other compounds such as aerosol-former, gelling agent, viscosifying agent, and nicotine. Also, gel compositions comprising no water or a low level of water are easier and require less energy to vaporize. Aerosols formed from a gel composition comprising no water or a low level of water can be perceived as less hot by the user. Preferably, the gel composition comprises less than about 40% wt, preferably less than about 30% wt, preferably less than about 25% wt water. The gel composition may comprise less than about 20% wt or less than about 15% wt or less than about 10% wt or less than about 5% wt of water. The gel composition may preferably comprise some water. The gel composition is more stable when the composition comprises some water. Preferably, the gel composition comprises at least about 1% wt, or at least about 2% wt or at least about 5% wt of water. Preferably, the gel composition comprises at least about 10% wt or at least about 15% wt water. Preferably, the gel composition comprises a range from about 15% wt to about 25% wt water.

The gel composition may include gelling agents being the hydrogen-bond crosslinking gelling agent and the ionic crosslinking gelling agent. The gel composition may further include a viscosifying agent. The gelling agents may form a solid medium in which the aerosol-former may be dispersed. The gelling agents may form a solid medium in which the aerosol-former and water may be dispersed. The viscosifying agent combined with the hydrogen-bond crosslinking gelling agent and the ionic crosslinking gelling agent appears to surprisingly support the solid medium and maintain the gel composition even when the gel composition comprises a high level of glycerine.

The gel composition may include the gelling agents in a range from about 0.4% to about 10% by weight. Preferably the composition may include the gelling agents in a range from about 0.5% to about 8% by weight. Preferably the composition may include the gelling agents in a range from about 1% to about 6% by weight. Preferably the composition may include the gelling agents in a range from about 2% to about 4% by weight. Preferably the composition may include the gelling agents in a range from about 2% to about 3% by weight.

The gel composition may include the viscosifying agent in a range from about 0.2% to about 5% by weight. Preferably the viscosifying agent in a range from about 0.5% to about 3% by weight. Preferably the viscosifying agent in a range from about 0.5% to about 2% by weight. Preferably the viscosifying agent in a range from about 1% to about 2% by weight.

The gel composition may include the viscosifying agent, hydrogen-bond crosslinking gelling agent, and ionic crosslinking gelling agent being present in the gel composition in a total amount from about 1% wt to about 8% wt. Preferably the gel composition may include the viscosifying agent, hydrogen-bond crosslinking gelling agent, and ionic crosslinking gelling agent being present in the gel composition in a total amount from about 2% wt to about 6% wt. Preferably the gel composition may include the viscosifying agent, hydrogen-bond crosslinking gelling agent, and ionic crosslinking gelling agent being present in the gel composition in a total amount from about 3% wt to about 5% wt.

The gel composition may include the viscosifying agent, hydrogen-bond crosslinking gelling agent, and ionic crosslinking gelling agent each independently present in the gel composition in a range from about 0.3% wt to about 3% wt. Preferably the gel composition may include the viscosifying agent, hydrogen-bond crosslinking gelling agent, and ionic crosslinking gelling agent each independently present in the gel composition in a range from about 0.5% wt to about 2% wt. Preferably the gel composition may include the viscosifying agent, hydrogen-bond crosslinking gelling agent, and ionic crosslinking gelling agent each independently present in the gel composition in a range from about 1% wt to about 2% wt.

The viscosifying agent may include one or more of xanthan gum, carboxymethyl-cellulose, microcrystalline cellulose, methyl cellulose, gum Arabic, guar gum, lambda carrageenan, or starch. The viscosifying agent may preferably include xanthan gum.

The gel composition may include viscosifying agent such as xanthan gum in a range from about 0.2% to about 5% by weight. Preferably the xanthan gum may be in a range from about 0.5% to about 3% by weight. Preferably the xanthan gum may be in a range from about 0.5% to about 2% by weight. Preferably the xanthan gum may be in a range from about 1% to about 2% by weight.

The hydrogen-bond crosslinking gelling agent may include one or more of a galactomannan, gelatin, agarose, or konjac gum, or agar. The hydrogen-bond crosslinking gelling agent may preferably include agar.

The gel composition may include the hydrogen-bond crosslinking gelling agent such as agar in a range from about 0.3% to about 5% by weight. Preferably the composition may include the hydrogen-bond crosslinking gelling agent in a range from about 0.5% to about 3% by weight. Preferably the composition may include the hydrogen-bond crosslinking gelling agent in a range from about 1% to about 2% by weight.

The ionic crosslinking gelling agent may include low acyl gellan, pectin, kappa carrageenan, iota carrageenan or alginate. The ionic crosslinking gelling agent may preferably include low acyl gellan.

The gel composition may include the ionic crosslinking gelling agent such as low acyl gellan in a range from about 0.3% to about 5% by weight. Preferably the composition may include the ionic crosslinking gelling agent in a range from about 0.5% to about 3% by weight. Preferably the composition may include the ionic crosslinking gelling agent in a range from about 1% to about 2% by weight.

The gel composition may further include a divalent cation. Preferably the divalent cation may include calcium ions, such as calcium lactate in solution. Divalent cations (such as calcium ions) may assist in the gel formation of compositions that include gelling agents such as the ionic crosslinking gelling agent, for example. The ion effect may assist in the gel formation. The divalent cation may be present in the gel composition in a range from about 0.1 to about 1% by weight, or about 0.5% wt.

The gel composition may further include an acid. The acid may comprise a carboxylic acid. The carboxylic acid may include a ketone group. Preferably the carboxylic acid may include a ketone group has less than about 10 carbon atoms, or less than about 6 carbon atoms or less than about 4 carbon atoms, such as levulinic acid or lactic acid. Preferably this carboxylic acid has three carbon atoms (such as lactic acid). Lactic acid surprisingly improves the stability of the gel composition even over similar carboxylic acids. The carboxylic acid may assist in the gel formation. The carboxylic acid may reduce variation of the nicotine concentration within the gel composition during storage.

The gel composition may include a carboxylic acid such as lactic acid in a range from about 0.1% to about 5% by weight. Preferably the carboxylic acid may be in a range from about 0.5% to about 3% by weight. Preferably the carboxylic acid may be in a range from about 0.5% to about 2% by weight. Preferably the carboxylic acid may be in a range from about 1% to about 2% by weight.

Nicotine is included in the gel compositions. The nicotine may be added to the composition in a free base form or a salt form. The gel composition may include about 0.5 to about 10% wt, nicotine, or about 0.5 to about 5% wt. nicotine. Preferably the gel composition may include about 1 to about 3% wt, nicotine, or about 1.5 to about 2.5% wt. nicotine, or about 2% wt nicotine. The nicotine component of the gel formulation may be the most volatile component of the gel formulation. In some aspects water may be the most volatile component of the gel formulation and the nicotine component of the gel formulation may be the second most volatile component of the gel formulation.

An aerosol generating system may comprise: a heat source; an aerosol generating substrate; at least one air inlet downstream of the aerosol generating substrate; and an airflow pathway extending between the at least one air inlet and the mouth-end of the article. The heat source is preferably upstream from the aerosol generating substrate. The heat source may be integral with an aerosol generating device and a consumable aerosol generating article may be releasably received within the aerosol generating device.

The heat source may be a combustible heat source, a chemical heat source, an electrical heat source, a heat sink or any combination thereof. The heat source may be an electrical heat source, preferably shaped in the form of a blade that can be inserted into the aerosol generating substrate. Alternatively, the heat source may be configured to surround the aerosol generating substrate, and as such may be in the form of a hollow cylinder, or any other such suitable form. Alternatively, the heat source is a combustible heat source. As used herein, a combustible heat source is a heat source that is itself combusted to generate heat during use, which unlike a cigarette, cigar or cigarillo, does not involve combusting the aerosol generating substrate. A combustible heat source may comprise carbon and an ignition aid, such as a metal peroxide, superoxide, or nitrate, wherein the metal is an alkali metal or alkaline earth metal.

The aerosol generating substrate may include an induction heating element or susceptor or a plurality of induction heating elements or susceptors. Induction heating elements or susceptors heat up in the presence of an alternating or fluctuating electromagnetic field. When heating is by induction heating, a fluctuating electromagnetic field is transmitted through the aerosol generating article to the induction heating element or susceptor such that the susceptor or inducting heating element changes the fluctuating field into thermal energy thus heating the aerosol generating substrate.

The induction heating element or susceptor may be formed from any material that can be inductively heated to a temperature sufficient to generate an aerosol from the aerosol generating substrate. The induction heating element or susceptor may comprises a metal or carbon. A preferred induction heating element or susceptor may comprise a ferromagnetic material, for example ferritic iron, or a ferromagnetic steel or stainless steel. The induction heating element or susceptor may comprise aluminium. Induction heating element or susceptors may be formed from 400 series stainless steels, for example grade 410, or grade 420, or grade 430 stainless 20 steel. Different materials will dissipate different amounts of energy when positioned within electromagnetic fields having similar values of frequency and field strength. Preferably, the induction heating element or susceptors are heated to a temperature in excess of 250 degrees Celsius. However, preferably the induction heating element or susceptors are heated less than 350 degrees Celsius to prevent burning of material in contact with the susceptor.

The induction heating element or susceptor may be located proximate the wrapper of the aerosol generating substrate since the wrapper described herein advantageously resists combustion.

The term "mouthpiece" is used herein to indicate the portion of the aerosol generating article that is designed to be contacted with the mouth of the consumer. The mouthpiece can be the portion of the aerosol generating article that may include a filter, or in some cases the mouthpiece can be defined by the extent of the tipping wrapper. In other cases, the mouthpiece can be defined as a portion of the aerosol generating article extending about 40 mm from the mouth end of the aerosol generating article or extending about 30 mm from the mouth end of the aerosol generating article.

The terms "upstream" and "downstream" refer to relative positions of elements of the aerosol generating article described in relation to the direction of aerosol as it is drawn from an aerosol generating substrate and through the mouthpiece.

The term "wrapper" or "paper wrapper" are interchangeable and refer to one or more layers of wrapping material that circumscribes an aerosol generating substrate to contain the aerosol generating substrate or maintain the shape of the aerosol generating article and is formed of paper. The wrapper mitigates spotting on the exterior surface of the aerosol generating article. Preferably the wrapper contacts the aerosol generating substrate.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees.

Elongation to break values are reported as % calculated from the elongation at break in mm divided by the total distance paper being stretched. Elongation to break values are measured according to ISO 1924-2—Paper and Board—Determination of tensile properties—part 2: Constant rate of elongation method.

The Elongation to break test method ISO 1924-2 is performed as follows: After conditioning at least 24 hours at 22±2° C. and 60±5% R.H., a test specimen of given dimensions (15±0.1 mm width and 250 mm length, cut either on Machine-Direction of the paper or Cross-Direction) is stretched to rupture at a constant rate of elongation (8 mm/min) using a tensile testing instrument (universal tensile/compression testing machine Instron 5566 or equivalent with a tension load cell of 100N Instron or equivalent). Force/Elongation curve is recorded with acquisition software Merlin or equivalent and Elongation/Stretch at Break in % calculated from the elongation at break in mm divided by the distance between the pneumatic action grips (180±0.5 mm).

The present disclosure relates to a paper wrapper used in aerosol generating articles, wherein the wrapper comprises a paper layer having a low elongation to break ratio CD/MD and may be utilized with an aerosol generating substrate. According to this disclosure, there is provided an aerosol generating article comprising an aerosol generating substrate comprising nicotine, and a wrapper disposed about the aerosol generating substrate. The wrapper comprises a paper layer having a low elongation to break ratio CD/MD preferably about 2.5 or less, or preferably about 2.2 or less, or preferably about 2 or less.

The wrapper may have an elongation at break in the cross direction (CD) in a range from about 3% to about 5%. The wrapper may have an elongation at break in the machine direction (MD) in a range from about 1% to about 3%.

The wrapper comprises a paper layer having a thickness/grammage in a range from about 0.8 micrometers/gsm to about 1.2 micrometers/gsm. The paper layer may have a thickness/grammage in a range from about 1.0 micrometers/gsm to about 1.2 micrometers/gsm. The paper layer may have a thickness/grammage in of about 1.0 micrometers/gsm. The paper layer may have a thickness/grammage of about 0.9 micrometers/gsm. The paper layer may have a thickness/grammage of about 1.0 micrometers/gsm. The paper layer may have a thickness/grammage of about 1.1 micrometers/gsm. The paper layer may have a thickness/grammage in of about 1.2 micrometers/gsm.

The paper layer may have a thickness of less than about 50 micrometers, or less than about 40 micrometers. The paper layer may have a thickness in a range from about 10 micrometers to about 50 micrometers. The paper layer may have a thickness in a range from about 20 micrometers to about 50 micrometers. The paper layer may have a thickness in a range from about 30 micrometers to about 50 micrometers. The paper layer may have a thickness in a range from about 35 micrometers to about 50 micrometers. The paper layer may have a thickness in a range from about 35 micrometers to about 40 micrometers. The paper layer may have a thickness in a range from about 40 micrometers to about 50 micrometers.

The paper layer may have a grammage in a range from about 25 gsm to about 45 gsm. The paper layer may have a grammage in a range from about 30 gsm to about 45 gsm. The paper layer may have a grammage in a range from about 35 gsm to about 45 gsm. The paper layer may have a grammage in a range from about 35 gsm to about 40 gsm.

In one embodiment, a paper layer has an elongation to break in the cross-direction (CD) of about 4%, and an elongation to break in the machine-direction (MD) of about 2%.

In one embodiment, a paper layer has an elongation to break in the cross-direction (CD) of about 4%, and an elongation to break in the machine-direction (MD) of about 2%. This paper layer has a grammage of about 35 gsm to about 40 gsm and a thickness of about 35 micrometers to about 45 micrometers.

In one embodiment, a paper layer has an elongation to break in the cross-direction (CD) of about 4%, and an elongation to break in the machine-direction (MD) of about 2%. This paper layer has a grammage of about 35 gsm to about 40 gsm and a thickness of about 35 micrometers to about 45 micrometers. This paper layer has a water contact angle of about 35 degrees to about 50 degrees.

In one embodiment, a paper layer has a low elongation to break ratio CD/MD of about 2, a water contact angle of about 38 degrees, a grammage of about 35 gsm and a thickness of about 37 micrometers.

Preferably, the paper layer comprises PVOH (polyvinyl alcohol) or silicon. In one embodiment the paper layer includes PVOH (polyvinyl alcohol). The PVOH may be applied to the paper layer as a surface coating. The PVOH may be disposed on the exterior surface of the paper layer of the aerosol generating article. The PVOH may be disposed on and form a layer on the exterior surface of the paper layer of the aerosol generating article. The PVOH may be disposed on the interior surface of the paper layer of the aerosol generating article. The PVOH may be disposed on and form a layer on the interior surface of the paper layer of the aerosol generating article. The PVOH may be disposed on the interior surface and the exterior surface of the paper layer of the aerosol generating article. The PVOH may be disposed on and form a layer on the interior surface and the exterior surface of the paper layer of the aerosol generating article.

The paper layer may comprise a surface treatment comprising PVOH or silicon. The paper layer may comprise a surface treatment comprising PVOH. The paper layer may comprise a surface treatment comprising silicon. This surface treatment may be applied to the exterior surface of the paper layer. This surface treatment may be applied to the interior surface of the paper layer. This surface treatment may be applied to the exterior and interior surface of the paper layer. Addition of PVOH or silicon may improve the grease barrier properties of the paper layer.

The aerosol generating substrate may include a gel composition. The gel composition may comprise a majority of aerosol former such as glycerine. The gel composition may include nicotine, at least about 50% wt. glycerine or at least 70% wt. glycerine, at least about 0.2% wt. hydrogen-bond crosslinking gelling agent, at least about 0.2% wt. ionic crosslinking gelling agent, and at least about 0.2% wt. viscosifying agent. The gel composition may comprise xanthan gum.

The aerosol generating substrate may include homogenized tobacco material. The tobacco homogenized tobacco material may comprise tobacco material, from about 1% to about 5% of a binder, and from about 5% to about 30% of an aerosol-former, in dry weight basis.

The aerosol generating substrate may comprise a metallic induction heating element. The metallic induction heating element may comprise plurality of metallic induction heating elements. The metallic induction heating element may comprise a metallic induction heating ring element.

It is contemplated that the wrapper described herein may reduce and prevent formation of spots on an aerosol generating article that are visible to a consumer. It has been observed that spots can appear on an aerosol generating article upon storage in a humid environment or during consumption. The spots can be caused by absorption of water or aerosol former, including any coloured substances that are suspended or dissolved, into the web of cellulosic fibers that constitutes the wrapper. Without being bound by any theory, the water or aerosol former interacts with the cellulosic fibers of the paper and alters the organization of the fibers resulting in a local change in the optical properties, such as brightness, color, and opacity, and mechanical properties, such as tensile strength, permeability of the wrapper.

It is contemplated that the wrapper described herein may reduce and prevent swelling of the aerosol generating article. Reducing or preventing swelling of the aerosol generating article improves the usability of the aerosol generating article to securely insert and remove the aerosol generating article from a heating device without damage to the aerosol generating article.

The wrapper is the portion of the aerosol generating article that is disposed about the aerosol generating substrate to help maintain the cylindrical form of the aerosol generating article. The wrapper may contain the aerosol generating substrate over at least about 50% of the length of the plug of aerosol generating substrate. Preferably the wrapper contains the aerosol generating substrate over at least about 90% of the length of the plug of aerosol generating substrate. More preferably the wrapper contains the aerosol generating substrate over at least about 100% of the length of the plug of aerosol generating substrate.

This wrapper may exhibit a range of permeability including not being permeable. Permeability of cigarette paper is determined by utilizing the International Standard test method ISO 2965:2009 and the result is presented as cubic centimetres per minute per square centimetre and referred to as "CORESTA units". The permeability of the wrapper described herein may be in a range from about 1 to about 10 CORESTA units, about 5 to about 20 CORESTA units, or about 1 to about 5 CORESTA units.

The wrapper may be formed of any cellulosic material such as paper, wood, textile, natural as well as artificial fibers. Preferably the wrapper does not include fillers, such as calcium carbonate. Preferably the wrapper is formed of at least 90% wt cellulosic material. Preferably the wrapper is formed of at least 95% wt cellulosic material.

The paper layer may be formed of any cellulosic material such as paper, wood, textile, natural as well as artificial fibers. Preferably the paper layer does not include fillers, such as calcium carbonate. Preferably the paper layer is formed of at least 90% wt cellulosic material. Preferably the paper layer is formed of at least 95% wt cellulosic material.

The surface of the paper layer may have a water contact angle of at least about 30 degrees, at least about 35 degrees, at least about 40 degrees, or at least about 45 degrees. Hydrophobicity or water contact angle is determined by utilizing the TAPPI T558 test and the result is presented as an interfacial contact angle and reported in "degrees" and can range from near zero degrees to near 180 degrees.

The paper layer may have a negative result (no visible spotting) for at least one kit oil sample of method Tappi 559 cm-02 classical method 2002. The paper layer may have a negative result for at least five kit oil samples, or all ten kit oil sample of method Tappi 559 cm-02 classical method 2002.

The wrapper may include two layers of paper wherein a first layer has a first elongation to break ratio value and the second paper has a second elongation to break ratio value and the first elongation to break ratio value is less than the second elongation to break ratio value. The wrapper has a total thickness of less than about 80 micrometers.

The wrapper may include two layers of paper wherein a first layer has a first elongation to break ratio value and the second paper has a second elongation to break ratio value and the first elongation to break ratio value is greater than the second elongation to break ratio value. The wrapper has a total thickness of less than about 80 micrometers.

The wrapper may include two layers of paper wherein a first layer has a first elongation to break ratio value and the second paper has a second elongation to break ratio value and the first elongation to break ratio value is substantially equal to than the second elongation to break ratio value. The wrapper has a total thickness of less than about 80 micrometers.

The wrapper may include two layers of paper wherein the first layer contacts the aerosol forming substrate and the second layer overlays the first layer. The first layer may comprise PVOH (polyvinyl alcohol) or silicon or comprise a surface treatment comprising PVOH or silicon. The second layer may comprise PVOH (polyvinyl alcohol) or silicon or comprise a surface treatment comprising PVOH or silicon. Both of the first and second layers may comprise PVOH (polyvinyl alcohol) or silicon or comprise a surface treatment comprising PVOH or silicon. Only the first layer may comprise PVOH (polyvinyl alcohol) or silicon or comprise a surface treatment comprising PVOH or silicon. Only the second layer may comprise PVOH (polyvinyl alcohol) or silicon or comprise a surface treatment comprising PVOH or silicon.

Aerosol generating articles include an aerosol generating substrate that may comprise a charge of tobacco circumscribed by the wrapper described herein. The aerosol generating substrate may comprise any suitable type or types of tobacco material or tobacco substitute, in any suitable form. The aerosol generating substrate may include flue-cured tobacco, Burley tobacco, Maryland tobacco, Oriental tobacco, specialty tobacco, homogenized or reconstituted tobacco, or any combination thereof. The aerosol generating substrate may be provided in the form of tobacco cut filler, tobacco lamina, processed tobacco materials, such as volume expanded or puffed tobacco, processed tobacco stems, such as cut-rolled or cut-puffed stems, homogenized tobacco, reconstituted tobacco, cast leaf tobacco, or blends thereof, and the like. The term "tobacco cut filler" is used herein to indicate tobacco material that is predominately formed from the lamina portion of the tobacco leaf. The terms "tobacco cut filler" is used herein to indicate both a single species of Nicotiana and two or more species of Nicotiana forming a tobacco cut filler blend.

As used herein, the term "homogenised tobacco" denotes a material formed by agglomerating particulate tobacco. Homogenized tobacco may include reconstituted tobacco or cast leaf tobacco, or a mixture of both. The term "reconstituted tobacco" refers to paper-like material that can be made from tobacco by-products, such as tobacco fines, tobacco dusts, tobacco stems, or a mixture of the foregoing. Reconstituted tobacco can be made by extracting the soluble chemicals in the tobacco by-products, processing the left-over tobacco fibers into a sheet, and then reapplying the extracted materials in concentrated form onto the sheet. The term "cast leaf tobacco" is used herein to refer to a product resulting from a process well known in the art, which is based on casting a slurry comprising ground tobacco particles and a binder (for example, guar) onto a supportive surface, such as a belt conveyor, drying the slurry and removing the dried sheet from the supportive surface. Exemplary methods for producing these types of aerosol generating substrates are described in U.S. Pat. Nos. 5,724,998, 5,584,306, 4,341,228, 5,584,306 and 6,216,706. The homogenised tobacco may be formed into a sheet which is crimped, convoluted, folded, or otherwise compressed, before being wrapped to form a rod. For example, sheets of homogenised tobacco material for use in the invention may be crimped using a crimping unit of the type described in CH-A-691156, which comprises a pair of rotatable crimping rollers. However, it will be appreciated that sheets of homogenised tobacco material for use in the invention may be textured using other suitable machinery and processes that deform or perforate the sheets of homogenised tobacco material.

The aerosol generating substrate used in aerosol generating articles generally includes a higher level of aerosol former(s) than combusted smoking articles, such as cigarettes. Humectants can also be referred to as an "aerosol former". An aerosol former is used to describe any suitable known compound or mixture of compounds that, in use, facilitates formation of an aerosol and that is substantially resistant to thermal degradation at the operating temperature of the aerosol generating substrate. Suitable aerosol-formers are known in the art and include, but are not limited to: polyhydric alcohols, such as propylene glycol, triethylene glycol, 1,3-butanediol and glycerine; esters of polyhydric alcohols, such as glycerine mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine or glycerine. The aerosol generating substrate may comprise a single aerosol former. Alternatively, the aerosol generating substrate may comprise a combination of two or more aerosol formers.

The aerosol generating substrate may have a high level of aerosol former. As used herein, a high level of aerosol former means aerosol former content that is greater than about 10% or preferably greater than about 15% or more preferably greater than about 20%, by weight. The aerosol generating substrate can also have an aerosol former content of between about 10% and about 30%, from about 15% and about 30%, or from about 20% and about 30%, by weight.

The aerosol generating substrate can also have a glycerine content of between about 10% and about 30%, from about 15% and about 30%, or from about 20% and about 30%, by weight.

The aerosol generating substrate may comprise at least about 1%, or at least about 2%, or at least about 5%, or at least about 7%, or at least about 10%, or at least about 12%, or at least about 15%, or at least about 18% aerosol former, by weight. The aerosol generating substrate may comprise aerosol former in a range from about 1 to about 20%, or about 5 to about 20%, or about 10 to about 20%, by weight.

The aerosol generating substrate may comprise at least about 1%, or at least about 2%, or at least about 5%, or at least about 7%, or at least about 10%, or at least about 12%, or at least about 15%, or at least about 18% glycerine, by weight. The aerosol generating substrate may comprise glycerine in a range from about 1 to about 20%, or about 5 to about 20%, or about 10 to about 20%, by weight.

Gel form aerosol generating substrates may have a majority aerosol former, preferably glycerine. The gel composition may include a gelling agent forming a solid medium, an aerosol former such as glycerine dispersed in the solid medium, and nicotine dispersed in the glycerine. The composition forming a stable gel phase. The gel composition may include at least two gelling agents forming a solid medium, glycerine dispersed in the solid medium, and nicotine dispersed in the glycerine. The composition forming a stable gel phase. The gel composition may include a viscosifying agent, and gelling agent forming a solid medium, glycerine dispersed in the solid medium, and nicotine dispersed in the glycerine. The composition forming a stable gel phase. A gel composition may include nicotine, an aerosol former, a viscosifying agent, a hydrogen-bond crosslinking gelling agent, and an ionic crosslinking gelling agent. The gel composition may further include divalent cations.

The gel composition may include a majority of aerosol former such as glycerine. The gel composition may include a mixture of water and the glycerine where the glycerine forms a majority (by weight) of the gel composition. The glycerine may form at least about 50% wt. of the gel composition. The glycerine may form at least about 60% wt., or about 65% wt., or about 70% wt. of the gel composition. The glycerine may form at about 70% wt. to about 80% wt. of the gel composition. The glycerine may form at about 70% wt. to about 75% wt. of the gel composition.

The wrapper, described herein, is disposed about an aerosol generating substrate. The wrapper can reduce the absorption of aerosol former compounds and water onto the wrapper as air is drawn through the heated aerosol generating article.

Preferably, the aerosol generating article may be generally cylindrical. This enables a smooth flow of the aerosol. The aerosol generating article may have an outer diameter, for example, between 4 millimetres and 15 millimetres, between 5 millimetres and 10 millimetres, or between 6 millimetres and 8 millimetres. The aerosol generating article may have a length, for example, between 10 millimetres and 60 millimetres, between 15 millimetres to 50 millimetres, or between 20 millimetres and 45 millimetres.

The resistance to draw (RTD) of the aerosol generating article will vary depending on, among other things, the length and dimensions of the passageways, the size of the apertures, the dimensions of the most constricted cross-sectional area of the internal passageway, and the materials used. The RTD of the aerosol generating article may be between 50 millimetre of water (mm H2O) and 140 millimetre of water (mm H2O), between 60 millimetre of water (mm H2O) and 120 millimetre of water (mm H2O), or between 80 millimetre of water (mm H2O) and 100 millimetre of water (mm H2O). The RTD of the article refers to the static pressure difference between the one or more apertures and the mouth end of the article when it is traversed by an inner longitudinal passageway under steady conditions in which the volumetric flow is 17.5 millilitres per second at the mouth end. The RTD of a specimen can be measured using the method set out in ISO Standard 6565: 2002.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Figure 1:
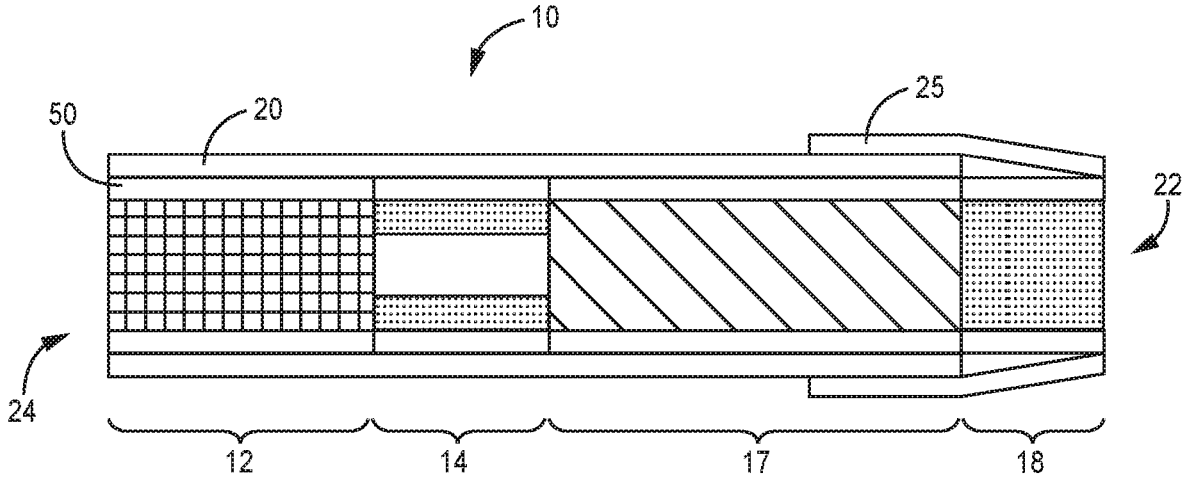
FIG. 1 is a schematic cross-sectional diagram of an aerosol generating article.

The aerosol generating articles depicted in FIGS. 1-4 illustrate one or more embodiments of aerosol generating articles or components of aerosol generating articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

The aerosol generating article 10, of FIG. 1, illustrates an aerosol-generating substrate 12 including a tobacco plug, a hollow cellulose acetate tube 14, a polylactic acid filter segment 17 and a mouthpiece segment 18 formed of cellulose acetate material. These four elements are individually wrapped with a paper layer. In particular, the aerosol-generating substrate 12 is wrapped with a first paper layer 50, as described herein. These four elements are arranged in end-to-end, longitudinal alignment.

The aerosol-generating substate 12, hollow cellulose acetate tube 14, a polylactic acid filter segment 16 are joined together and circumscribed by a second paper layer 20 to form an intermediate article. The mouthpiece segment 18 is joined to the intermediate article with tipping paper 25 to form the aerosol generating article 10. The first paper layer 50 and the second paper layer 20 may cooperate to form the wrapper as described herein.

The aerosol generating article 10 has a mouth end 22 and an upstream, distal end 24 located at the opposite end of the article to the mouth end 22. The aerosol generating article 10 shown in FIG. 1 is particularly suitable for use with an electrically operated aerosol generating device comprising a heater for heating the aerosol-generating substrate 12.

Figure 2:
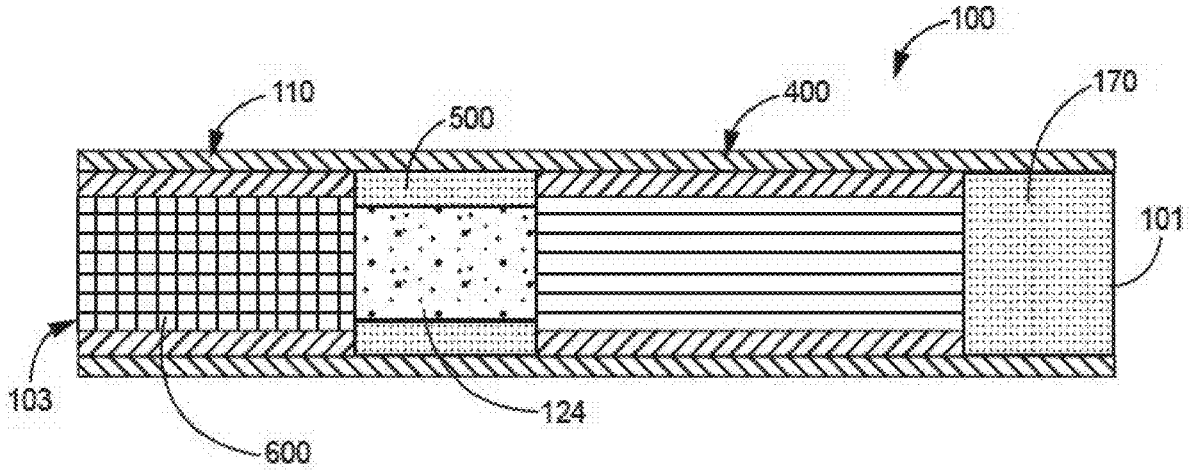
FIG. 2 is a schematic cross-sectional diagram of another aerosol generating article.

The aerosol generating article 100, of FIG. 2, comprises four elements arranged in coaxial alignment: at the distal end 103 an end plug 600 of high Resistance to Draw (RTD), a first paper layer 500 which circumscribes an aerosol generating substrate 124, a fluid guide 400 and a mouthpiece 170 at the proximal end 101. These four elements are arranged sequentially and are circumscribed by a second paper layer 110 to form the aerosol generating article 100. The aerosol generating article 100 has a proximal or mouth end 101, and a distal end 103 located at the opposite end of the aerosol generating article 100 from the proximal end 101. The first paper layer 500 and the second paper layer 110 cooperate to form the wrapper, as described herein.

Figure 3:
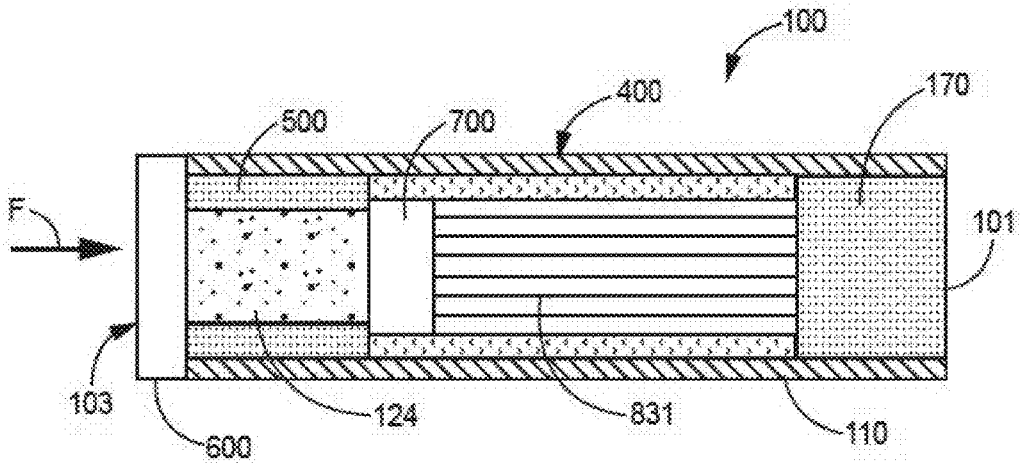
FIG. 3 is a schematic cross-sectional diagram of another aerosol generating article.

The aerosol generating article 100, of FIG. 3, illustrates, a cut away view, of an example of an aerosol generating article 100 that is suitable for induction heating as well as for heating with a blade like heating element.

The aerosol generating article 100 comprises a mouthpiece 170 at the proximal end 101, a fluid guide 400, a cavity 700, a first paper layer 500 which circumscribes an aerosol generating substrate 124 and an end plug 600 in the order proximal to distal. In this example the aerosol generating substrate 124 comprises a gel and a susceptor (not shown). The susceptor in this example is a single aluminium strip centrally located along the longitudinal axis of the aerosol generating substrate 124. On insertion of the distal end 103 of the aerosol generating article 100 into an aerosol generating device 200 (see FIG. 6) such that the portion of the aerosol generating article 100 is positioned to be in proximity to the induction heating elements 230 (see FIG. 5) of the aerosol generating device 200 (see FIG. 6). Electromagnetic radiation produced by the induction heating elements 230 is absorbed by the susceptor and aid heating of the aerosol generating substrate 124 in the first paper layer 500, in turn aiding the release of material from the aerosol generating substrate 124, for example nicotine entrained into the passing aerosol when a negative pressure is applied at the proximal end 101 of the aerosol generating article 100. Fluid, for example air, enters the outer longitudinal passageways 831 via apertures (not shown) to transfer to the cavity 700 and then to the aerosol generating substrate 124 where the fluid mixes with the aerosol generating substrate 124 and is entrained with nicotine before returning to the cavity and then via the inner longitudinal passageway (not shown) of the fluid guide 400 before exiting at the proximal end 101.

In this example a first paper layer 500 circumscribes an aerosol generating substrate 124 and the first paper layer 500 is circumscribed by a second paper layer 110. The first paper layer 500 and the second paper layer 110 form the wrapper, as described herein. The aerosol generating substrate 124 may include a gel composition.

Figure 5:
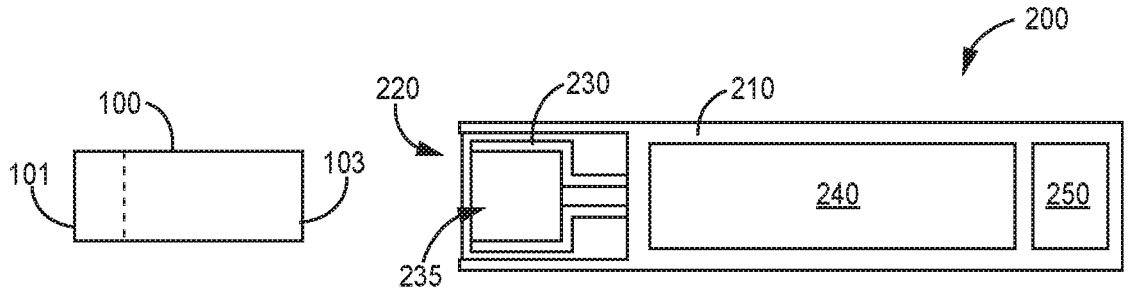
FIG. 5 and FIG. 6 are schematic cross-sectional diagrams of an aerosol generating system.
Figure 6:
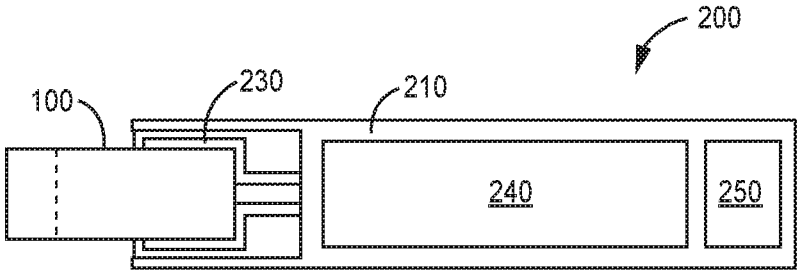

This aerosol generating article 100 illustrated in FIG. 2 and FIG. 3 may be used with the aerosol generating device 200 as illustrated in FIG. 5 and FIG. 6.

Figure 4:
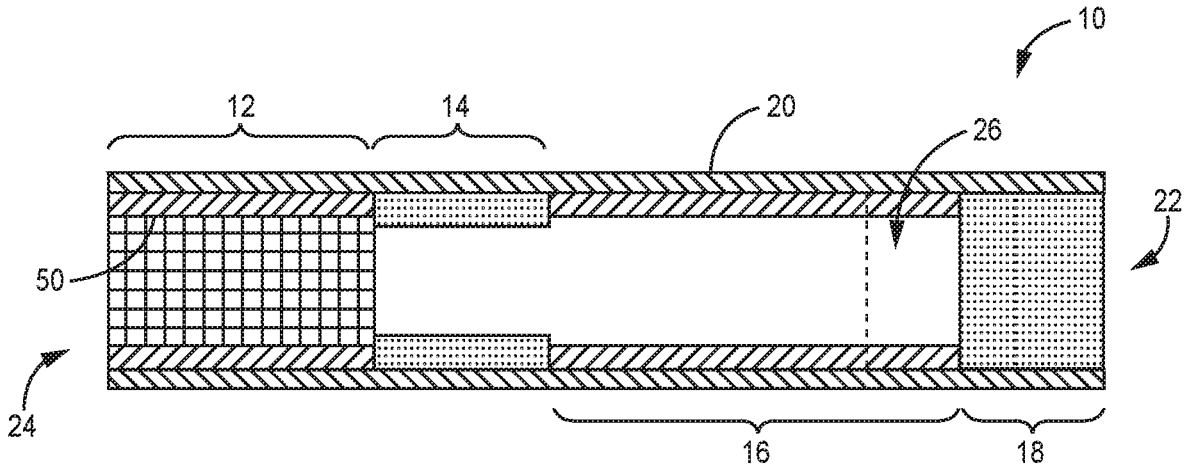
FIG. 4 is a schematic cross-sectional diagram of another aerosol generating article.

The aerosol generating article 10, of FIG. 4, illustrates an aerosol-generating substrate 12, a hollow cellulose acetate tube 14, a hollow tubular segment 16 and a mouthpiece segment 18. The aerosol-generating substrate 12 is wrapped with a first paper layer 50, as described herein. These four elements are arranged in end-to-end, longitudinal alignment and are circumscribed by a second paper layer 20 to form the aerosol-generating article 10. The first paper layer 50 and the second paper layer 20 may cooperate to form the wrapper as described herein.

The aerosol generating article 10 has a mouth end 22 and an upstream, distal end 24 located at the opposite end of the article to the mouth end 22. The aerosol generating article 10 shown in FIG. 4 is particularly suitable for use with an electrically operated aerosol generating device comprising a heater for heating the aerosol-generating substrate 12.

The aerosol generating substrate 12 has a length of about 12 millimetres and a diameter of about 7 millimetres. The aerosol generating substrate 12 is cylindrical in shape and has a substantially circular cross-section. The aerosol generating substrate 12 comprises a gathered sheet of homogenised tobacco material. The sheet of homogenised tobacco material comprises 10 percent by weight on a dry basis of glycerine. The hollow cellulose acetate tube 14 has a length of about 8 millimetres and a thickness of 1 millimetre. The mouthpiece segment 18 comprises a plug of cellulose acetate tow of 8 denier per filament and has a length of about 7 millimetres.

The hollow tubular segment 14 is provided as a cylindrical tube having a length of about 18 millimetres and a thickness of the tube wall is about 100 micrometres. The aerosol generating article 10 comprises a ventilation zone 26 provided at about 5 millimetres from an upstream end of the mouthpiece segment 18. Thus, the ventilation zone 26 is at about 12 millimetres from the downstream end of the aerosol generating article, and about 13 millimetres from the upstream end of the hollow tubular segment. Thus, the ventilation zone 26 is at about 21 millimetres from a downstream end of the aerosol generating substrate 12.

FIGS. 5-6 illustrate an example of an aerosol generating article 100 and aerosol generating device 200. The aerosol generating article 100 has a proximal or mouth end 101 and a distal end 103. In FIG. 5, the distal end 103 of the aerosol generating article 100 is received in a receptacle 220 of the aerosol generating device 200. The aerosol generating device 200 includes a housing 210 defining the receptacle 220, which is configured to receive the aerosol generating article 100. The aerosol generating device 200 also includes a heating element 230 that forms a cavity 235 configured to receive the aerosol generating article 100, preferably by interference fit. The heating element 230 may comprise an electrically resistive heating component. In addition, the device 200 includes a power supply 240 and control electronics 250 that cooperate to control heating of heating element 230.

The heating element 230 may heat the distal end 103 of the aerosol generating article 100. In this example the aerosol generating substrate 124 comprises a gel comprising nicotine. Heating of the aerosol generating article 100 causes the aerosol generating substrate 124 to generate an aerosol containing the nicotine which can transfer out of the aerosol generating article 100 at the proximal end 101. The aerosol generating device 200 comprises a housing 210. FIGS. 5-6 do not show the exact heating mechanism.

In some examples the heating mechanism could be by conduction heating where the heat is transferred from the heating element 230 of the aerosol generating device 200 to the aerosol generating article 100. This can take place easily when the aerosol generating article 100 is positioned in the receptacle 220 of the aerosol generating device 200 and the distal end 103 (which is preferably the end where the aerosol generating substrate 124 is located) and thus the aerosol generating article 100 is in contact with the heating element 230 of the aerosol generating device 200. In specific examples the heating element comprises a heating blade that protrudes from the aerosol generating device 200 and is suitable for penetrating into the aerosol generating article 100 to make direct contact with the aerosol generating substrate 124.

In this example the heating mechanism is by induction where the heating element emits radio-magnetic radiation which is absorbed by the tubular element when the aerosol generating article 100 is position in the receptacle 220 of the aerosol generating device 200.

Once the aerosol generating article 100 is releasably received in the aerosol generating device 200 and on the heating element 230, the aerosol generating device 200 is actuated to heat the aerosol generating substrate 124 to a temperature of approximately 375 degrees Celsius. As a user draws on the mouth end 101 of the aerosol generating article 100, the volatile compounds evolved from the aerosol generating substrate 124 are drawn downstream through the aerosol generating article 100 and condense to form an aerosol that is drawn through the mouthpiece 101 of the aerosol generating article 100 into the user's mouth. The wrapper 500, 110 repels aerosol former and moisture from the aerosol to reduce staining and weakening of the wrapper 500, 110.

The first paper layer 50, 500 has an elongation at break ratio of CD/MD is about 2.5 or less. Preferably the first paper layer 50, 500 has an elongation at break ratio of CD/MD is about 2.2 or less, or about 2 or less. Preferably the paper layer 50, 500 has an elongation at break ratio of CD/MD is in a range from about 1.8 to about 2.2.

Preferably, the first paper layer 50, 500 has a thickness/grammage of about 1.2 micrometers/gsm or less and a water contact angle of at least about 30 degrees. The first paper layer 50, 500 may have a thickness of less than about 50 micrometers, or less than about 40 micrometers. The first paper layer 50, 500 may have a grammage in a range from about 25 gsm to about 45 gsm, or from about 35 gsm to about 40 gsm.

Preferably, the first paper layer 50, 500 has a water contact angle of at least about 30 degrees and an elongation to break ratio CD/MD of about 2.5 or less. The first paper layer 50, 500 may have an elongation to break ratio CD/MD of about 2.2 or less, or about 2 or less.

Preferably, the first paper layer 50, 500 has an elongation at break ratio of CD/MD is about 2.5 or less and a negative result for at least one kit oil sample of method Tappi 559 cm-02 classical method 2002. The first paper layer 50, 500 may have a negative result for at least five kit oil samples, or all ten kit oil samples of method Tappi 559 cm-02 classical method 2002.

Preferably, the wrapper includes the first paper layer 50, 500 and the second paper layer 20, 110 wherein a first paper layer 50, 500 has an elongation at break ratio of CD/MD is about 2.5 or less.

Preferably, the wrapper includes the first paper layer 50, 500 and the second paper layer 20, 110 wherein a first paper layer 50, 500 has an elongation at break ratio of CD/MD is about 2.5 or less and the wrapper may has a total thickness of less than about 80 micrometers.

Preferably, the first paper layer 50, 500 comprises PVOH (polyvinyl alcohol) or silicon. The first paper layer 50, 500 may comprise a surface treatment comprising PVOH or silicon. Addition of PVOH (polyvinyl alcohol) or silicon may improve the grease barrier properties of the wrapper.

Preferably the second paper layer 20, 110 comprises PVOH (polyvinyl alcohol) or silicon. The second paper layer 20, 110 may comprise a surface treatment comprising PVOH or silicon. Addition of PVOH (polyvinyl alcohol) or silicon may improve the grease barrier properties of the wrapper.

The exemplary embodiments described above are not limiting. Other embodiments consistent with the exemplary embodiments described above will be apparent to those skilled in the art.

The invention claimed is:

1. An aerosol generating article comprising:

an aerosol generating substrate comprising nicotine and at least 10% by weight aerosol former comprising glycerine; and a wrapper disposed about and in contact with the aerosol generating substrate, the wrapper comprises a paper layer having an elongation at break ratio of cross direction/machine direction (CD/MD) of from 1.8 to 2.5, and wherein the paper layer has a grammage in a range from 25 g/m$^2$ to 45 g/m$^2$.

2. The aerosol generating article according to claim 1, wherein the paper layer having an elongation at break ratio of CD/MD is in a range from 2.2 to 1.8.

3. The aerosol generating article according to claim 1, wherein the paper layer has an elongation at break in the cross direction (CD) in a range from 3% to 5%, and the paper layer has an elongation at break in the machine direction (MD) in a range from 1% to 3%.

4. The aerosol generating article according to claim 1, wherein the paper layer has a thickness in a range from 35 micrometers to 50 micrometers.

5. The aerosol generating article according to claim 1, wherein the paper layer comprises PVOH or siloxane.

6. The aerosol generating article according to claim 1, wherein the paper layer comprises a surface treatment comprising PVOH or siloxane.

7. The aerosol generating article according to claim 1, wherein the paper layer comprises PVOH.

8. The aerosol generating article according to claim 1, wherein the paper layer comprises siloxane.

9. The aerosol generating article according to claim 1, wherein the aerosol generating substrate comprises a gel composition.

10. The aerosol generating article according to claim 9, wherein the gel composition comprises xanthan gum.

11. The aerosol generating article according to claim 1, wherein the aerosol generating substrate comprises homogenized tobacco material.

12. The aerosol generating article according to claim 11, wherein the tobacco homogenized tobacco material comprises tobacco material, from 1 percent to 5 percent of a binder, and from 5 percent to 30 percent of an aerosol-former, in dry weight basis.

13. The aerosol generating article according to claim 1, wherein the aerosol generating substrate comprises a metallic induction heating element.

14. The aerosol generating article according to claim 1, wherein the aerosol generating substrate comprises a plurality of metallic induction heating elements.

15. The aerosol generating article according to claim 1, wherein the paper layer has an elongation at break in the cross direction (CD) of 4%.

16. The aerosol generating article according to claim 1, wherein the paper layer has an elongation at break in the machine direction (MD) of 2%.

17. The aerosol generating article according to claim 1, wherein the paper layer being in contact with the aerosol generating substrate.

18. An aerosol generating article comprising:

an aerosol generating substrate comprising nicotine and at least 10% by weight aerosol former comprising glycerine; and a wrapper disposed about and in contact with the aerosol generating substrate, the wrapper comprises a paper layer in contact with the aerosol generating substrate and having an elongation at break ratio of cross direction/machine direction (CD/MD) of from 1.8 to 2.5, wherein the paper layer has a grammage in a range from 25 $g/m^2$ to 45 $g/m^2$, and a thickness in a range from 35 micrometers to 50 micrometers.

* * * * *